US005159888A

United States Patent [19]

Morita

[11] Patent Number: 5,159,888

[45] Date of Patent: Nov. 3, 1992

[54] AUTOMATIC SEWING MACHINE CAPABLE OF FAST JUMP STITCHING

[75] Inventor: Tetsuo Morita, Nagoya, Japan

[73] Assignee: Brother Kogyo Kabushiki Kaisha, Nagoya, Japan

[21] Appl. No.: 866,361

[22] Filed: Apr. 10, 1992

[30] Foreign Application Priority Data

Apr. 24, 1991 [JP] Japan ..... 3-122036

[51] Int. Cl.[5] ..... D05B 21/00; D05C 5/04

[52] U.S. Cl. ..... 112/121.12; 112/103; 112/221

[58] Field of Search ..... 112/121.12, 121.11, 112/102, 103, 221, 78, 86

[56] References Cited

U.S. PATENT DOCUMENTS

| | | | |
|---|---|---|---|
| 4,325,313 | 4/1982 | Kawai et al. | 112/103 |
| 4,506,612 | 3/1985 | Yanagi | 112/121.12 |
| 4,665,847 | 5/1987 | Takano et al. | 112/121.12 |
| 4,776,291 | 10/1988 | Tajima et al. | 112/221 X |
| 4,858,542 | 8/1989 | Kato et al. | 112/121.12 |

FOREIGN PATENT DOCUMENTS

| | | |
|---|---|---|
| 2-4706 | 1/1990 | Japan . |
| 2-13061 | 4/1990 | Japan . |

*Primary Examiner*—Peter Nerbun
*Attorney, Agent, or Firm*—Oliff & Berridge

[57] ABSTRACT

An automatic sewing machine having a needle-bar drive device for reciprocating a needle bar carrying a needle, a feed device for producing a relative movement between the needle bar and a work fabric, a feed control device for controlling the feed device according to stitch data indicative of needle positions, and a needle-bar jump device for disconnecting the needle bar from the needle-bar drive device and for holding the needle bar at a predetermined position above the fabric. The sewing machine is provided with a unique jump stitching arrangement operable, when the stitch length represented by a particular set of stitch data exceeds a maximum stitch length, for performing a jump stitching operation which includes: placing the feed control device in an inoperative state; placing the jump device and the feed device in operated states to produce a continuous relative movement of the needle bar and fabric; and restoring the feed control and jump devices to an operative state and a non-operated state, respectively, when a needle position represented by said particualr set of stitch data is reached by the continuous relative movement.

14 Claims, 10 Drawing Sheets

AUTOMATIC SEWING MACHINE CAPABLE OF FAST JUMP STITCHING

BACKGROUND OF THE INVENTION

1. Field of the Invention

The present invention relates generally to an automatic sewing machine, and more particularly to an automatic sewing machine capable of performing a jump stitching operation in which the work fabric is fed while the needle is held at a predetermined position above the work fabric.

2. Discussion of the Prior Art

In an automatic sewing machine, the work fabric supported by a fabric holder is fed by a feed device in an X-Y coordinate system, while the needle carried by the needle bar is positioned above the work fabric, during each reciprocating movement of the needle bar which takes place for each revolution of the main spindle. Thus, a stitch having a desired length is formed for each reciprocation of the needle bar for each revolution of the main spindle. However, the feed distance of the fabric that can be obtained while the needle is above the fabric during each revolution of the main spindle is limited. To obviate this limitation, there has been proposed a needle-bar jump device which operates to hold the needle bar at a predetermined position to maintain the needle above the fabric, when the desired stitch length is larger than the maximum stitch length. This needle-bar jump device, which permits the work fabric to be fed a distance larger than the maximum stitch length, is disclosed Publications 2-4706 and 2-13061 of Japanese Patent Applications, which were laid open for opposition purpose, in Jan. 30 and Apr. 3, 1990, respectively. Automatic sewing machines are adapted such that the fabric holder is moved to feed the fabric only during a portion of the time duration of each revolution of the main spindle, which portion corresponds to the time span normally assigned to the movement of the needle above the fabric when the needle-bar jump device is not operated. In other words, the fabric holder is not moved during the other portion of the time duration of each revolution of the main spindle, which is assigned to the movement of the needle below the fabric when the needle-bar jump device is in the non-operated state.

The needle-bar jump device is operated by activation of a suitable actuator such as a solenoid. A jump stitching operation implemented as disclosed in the above-identified publications is shown in FIG. 10, which indicates intermittent activation of the feed device and the solenoid of the needle-bar jump device. Dashed line in FIG. 10 indicates the reciprocating movements of the needle when the needle-bar jump device is not operated.

The length of each stitch is represented by stitch data, whereas the maximum stitch length is determined by the maximum feed distance of the fabric holder for each revolution of the main spindle (i.e., maximum feed distance during the time when the needle is above the fabric). If the commanded stitch length represented by the stitch data is considerably larger than the maximum stitch length or maximum feed distance, the needle-bar jump device must be activated intermittently a considerably large number of times, as indicated in FIG. 10. This results in an accordingly long jump stitching operation for one jump stitch, increasing the overall sewing time and lowering the sewing efficiency.

SUMMARY OF THE INVENTION

It is therefore an object of the present invention to provide an automatic sewing machine capable of performing an efficient jump stitching operation in a comparatively short time, for forming a stitch whose length is larger than the maximum stitch length.

The above object may be achieved according to the principle of this invention, which provides an automatic sewing machine comprising: (a) a needle bar carrying a needle; (b) a needle-bar drive device having a needle-bar drive source, for reciprocating the needle bar in a longitudinal direction thereof; (c) a feed device for producing a relative movement between the needle bar and a work fabric, in a direction substantially perpendicular to the longitudinal direction; (d) stitch data reading means for reading stitch data indicative of needle positions at which the needle penetrates a work fabric; (e) feed control means for controlling the feed device according to the stitch data read by the stitch data reading means, when the needle is above the work fabric; (f) a needle-bar jump device for disconnecting the needle bar from the needle-bar drive source, and holding the needle bar at a predetermined position to maintain the needle above the work fabric; and (g) jump stitching means operable, when a stitch length represented by the stitch data read by the stitch data reading means exceeds a maximum stitch length, for executing a jump stitching operation which includes placing the feed control means in an inoperative state, placing the needle-bar jump device and the feed device in operated states to produce a continuous relative movement of the needle bar and the work fabric, and restoring the feed control means and the needle-bar jump device to an operative state and a non-operated state, respectively, when a needle position represented by the stitch data is reached by the continuous relative movement.

In the automatic sewing machine of the present invention constructed as described above, a jump stitch operation is implemented by the jump stitching means when the stitch length represented by the stitch data read by the stitch data reading means is larger than the maximum stitch length. More specifically, the feed control means is placed in the inoperative state, and the needle-bar jump device is operated. The feed device is held in the operated state to produce a continuous relative movement between the needle bar and the work fabric, which continues until the needle position represented by the stitch data is reached by the obtained continuous relative movement. Namely, the jump stitching means restores the feed control means to the operative state and the needle-bar jump device to a non-operated state, when the obtained continuous relative movement becomes equal to the stitch length represented by the stitch data.

Thus, the present sewing machine is capable of continuously producing the relative movement of the needle bar and the work fabric, with the needle bar held at the predetermined position to maintain the needle above the fabric, so as to obtain the commanded stitch length which cannot be normally obtained during one revolution of the main spindle. Since the needle is held above the fabric, no stitch is formed while the feed device is operated, whereby a jump stitch whose length exceeds the maximum stitch length is formed during two or more revolutions of the main spindle. In this respect, it is significant to note that the feed device is not intermittently operated, but is held in the operated state for a time necessary to obtain the desired stitch length. Namely, the the needle is positioned above the fabric by the needle-bar jump device and the feed device is continuously operated, to form a jump stitch having any length larger than the maximum stitch length. Accordingly, the overall sewing efficiently is improved.

The needle-bar jump device may be continuously operated as long as the feed device is operated. Alternatively, the jump device may be intermittently operated for a predetermined interval corresponding to the rotating speed of the main spindle, provided that the timing and time of operation of each operation of the jump device permits the needle to be held above the work fabric.

BRIEF DESCRIPTION OF THE DRAWINGS

The above and optional objects, features and advantages of this invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
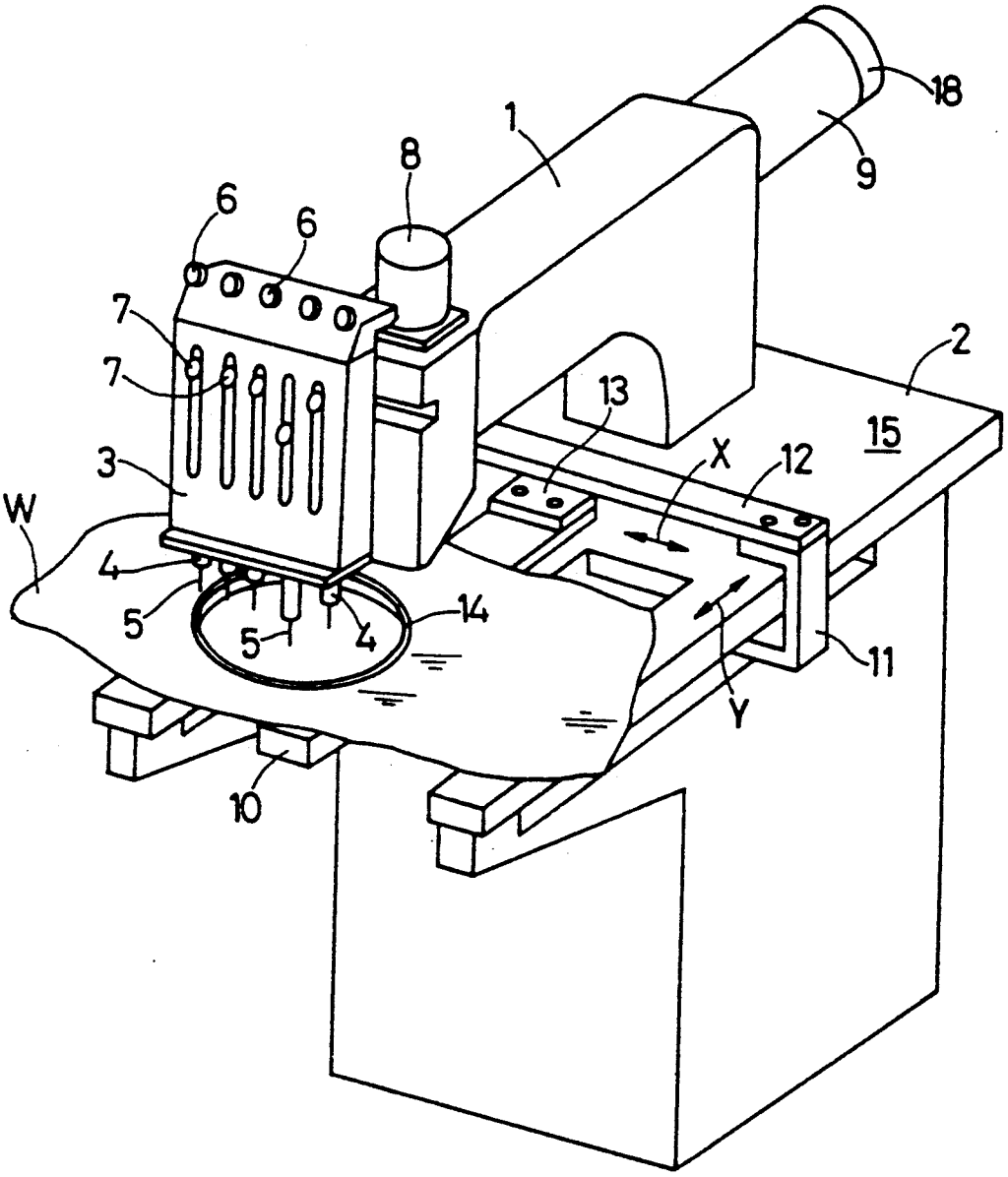
FIG. 1 is a perspective view showing one embodiment of an automatic sewing machine of the present invention.

Referring first to FIG. 1, an automatic sewing machine has an arm 1 mounted on a table 2. The machine arm 1 has a horizontally extending portion whose front end (left-hand side end as seen in FIG. 1) carries a needle bar support casing 3. The support casing 3 is movable in the X-axis direction indicated by arrows, and supports five needle bars 4 such that the needle bars 4 are movable in the vertical direction perpendicular to the X-axis direction. Each needle bar 4 carries at its lower longitudinal end a needle 5 removably fixed thereto. The five needles 5 are supplied with respective different threads, via respective tension regulars 6 and thread take-up levers 7 supported on the support casing 3. A needle-bar selector motor 8 is mounted atop the front end portion of the machine arm 1, and operatively linked with the support casing 3, for moving the support casing 3 in the X-axis direction. The selector motor 8 is operated according to a needle-bar selecting signal indicative of one of the five needle bars 4, to move the support casing 3 so that the needle bar 4 indicated by the selecting signal is brought into a predetermined operating position.

Figure 2:
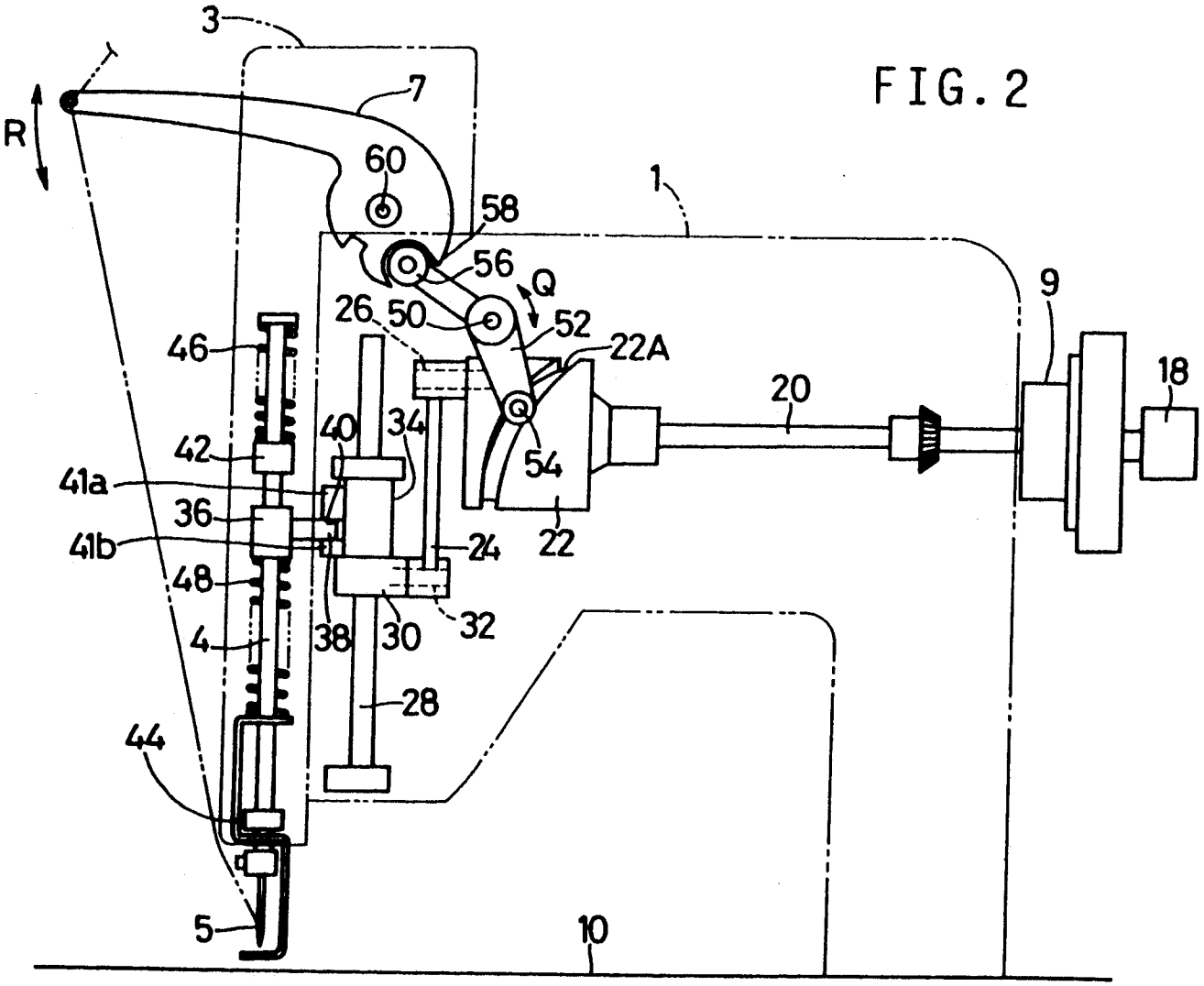
FIG. 2 is a front elevational view showing mechanisms incorporated in the sewing machine of FIG. 1, for reciprocating the needle bar and operating the thread take-up lever.

A sewing motor 9 is attached to the rear end of the machine arm 1, such that a power is transmitted from the motor 9 to the needle bar 4 in the operating position, through a transmission mechanism as shown in FIG. 2, so that the needle bar 4 is vertically reciprocated in the longitudinal direction thereof. An encoder 18 is connected to the sewing motor 9. The encoder 18 functions as needle position detecting means for detecting the position of the needle bar 4 during its reciprocation.

The machine table 2 is provided with a machine bed 10 attached thereto in opposed relationship with the needle bar 4 placed in the operating position. The machine bed 10 incorporates a full-rotation shuttle which cooperates with the needle 5 to constitute a major portion of stitch forming instrumentality for forming stitches on a work fabric W, as well known in the art.

The machine table 2 is further provided with a pair of Y-axis movers 11 (only one of which is shown in FIG. 1), which are movable along the respective opposite side edges of the table 2, in the Y-axis direction perpendicular to the X-axis direction. The Y-axis movers 11 are operated by a suitable Y-axis drive motor. These two Y-axis movers 11 carry a beam 12 extending and fixed therebetween in the X-axis direction. An X-axis mover 13 is supported at a proximal end thereof by the beam 12 such that the X-axis mover 13 is movable along the beam 12, namely, in the X-axis direction. The X-axis mover 13 is moved by a suitable Y-axis drive motor. A fabric holder 14 for removably holding the work fabric W is mounted on the X-axis mover 13.

The Y-axis and X-axis movers 11, 13 cooperate with the X-axis and Y-axis drive motors to constitute a feed device 15 for producing a relative movement between the needle bar 4 (needle 5) and the fabric holder 14 (work fabric W), in synchronization with reciprocating movements of the needle bar 4 (needle 5) or operation of the sewing motor 9, so that stitches such as embroidery patterns are formed on the fabric W.

Referring to FIG. 2, there are shown power transmission mechanisms for operating the needle bars 4 and the thread take-up levers 7. Within the machine arm 1, there is disposed a main spindle 20 rotated by the sewing motor 9. The main spindle 20 is connected, at its end remote from the motor 9, to a cylindrical cam 22 having a cam groove 22A formed on its outer circumferential surface. On the front end face of the cam 22, there is provided a connecting pin 26 to which a crank lever 24 is pivotally connected at one end thereof.

The machine arm 1 also incorporates a guide rod 28 fixed therein so as to extend in the vertical direction. A first reciprocating member 30 is fitted on the guide rod 28 such that the member 30 is slidably reciprocable in the vertical direction, i.e., in the longitudinal direction of the rod 28. This first reciprocating member 30 is connected through a pin 32 to the end of the crank lever 24 remote from the pin 26 on the cam 22.

A rotatable member 34 is also fitted on the guide rod 28 such that the member 34 is rotatable about the axis of the rod 28, relative to the first reciprocating member 30. This rotatable member 32 is reciprocated with the first reciprocating member 30. Each of the needle bars 4, which extend parallel to the guide rod 28, has a second reciprocating member 36 fixed thereto so that the member 36 is reciprocated with the needle bar 4. The second reciprocating member 36 is provided with an engaging pin 38 extending therefrom toward the rotatable member 34. On the other hand, the rotatable member 34 has an upper and a lower tab 41*a*, 41*b* which are spaced apart from each other in the longitudinal direction of the guide rod 28, so as to define an engaging recess 40 engageable with the engaging pin 38. The rotatable member 34 is spring-biased toward a first angular position for engagement with the engaging pin 38, and can be rotated toward a second angular position for disengagement from the engaging pin 38.

Each needle bar 4 is supported by upper and lower supports 42, 44 fixed to the support casing 3, such that the needle bar 4 is slidably reciprocable in its longitudinal direction, namely, in the vertical direction. The needle bar 4 is biased by a compression coil spring 46 in the upward direction, whereby the needle bar 4 is brought to the uppermost position, when the engaging pin 38 of the second reciprocating member 36 is not in engagement with the engaging recess 40 of the rotatable member 34.

The sewing motor 9, main spindle 20, cylindrical cam 22, crank lever 24, first reciprocating member 30, rotatable member 34 with the engaging recess 40, and second reciprocating member 36 with the engaging pin 38 cooperate to constitute a major portion of a needle-bar drive device for reciprocating the needle bar in its longitudinal direction. The motor 9 is a needle-bar drive source.

A stationary pivot pin 50 is fixed to the machine arm 1, so as to extend in the horizontal direction, near the thread take-up levers 7. The pivot pin 50 pivotally supports a pivot lever 52, which carries at its lower end a cam follower 54 such that the cam follower 54 is freely rotatable. The cam follower 54 slidably engages the cam groove 22A of the cylindrical cam 22, so that the pivot lever 52 is pivoted about the pin 50 when the cam 22 is rotated by the motor 9 via the main spindle 20. The pivot lever 56 carries a roller 56 rotatably fixed to its upper end. The roller 56 is engageable with a cutout 58 formed in the proximal end portion of each thread take-up lever 7, when the needle bar 4 corresponding to the take-up lever 7 is brought to the operating position. The take-up lever 7 is pivoted about a pivot pin 60, when the pivot lever 52 is pivoted by the cam 22.

When the cylindrical cam 22 is rotated by the main spindle 20, the pivot lever 52 is pivoted about the pivot pin 50, alternately in the clockwise and counterclockwise directions as indicated by arrows Q in FIG. 2, whereby the thread take-up lever 7 is pivoted about the pin 60 as indicated by arrows R. At the same time, the first reciprocating member 30 is vertically reciprocated by the crank lever 24. Since the engaging pin 38 is normally in engagement with the engaging recess 40, the second reciprocating member 36 is similarly reciprocated with the first reciprocating member 30 and the rotatable member 34.

Figure 3:
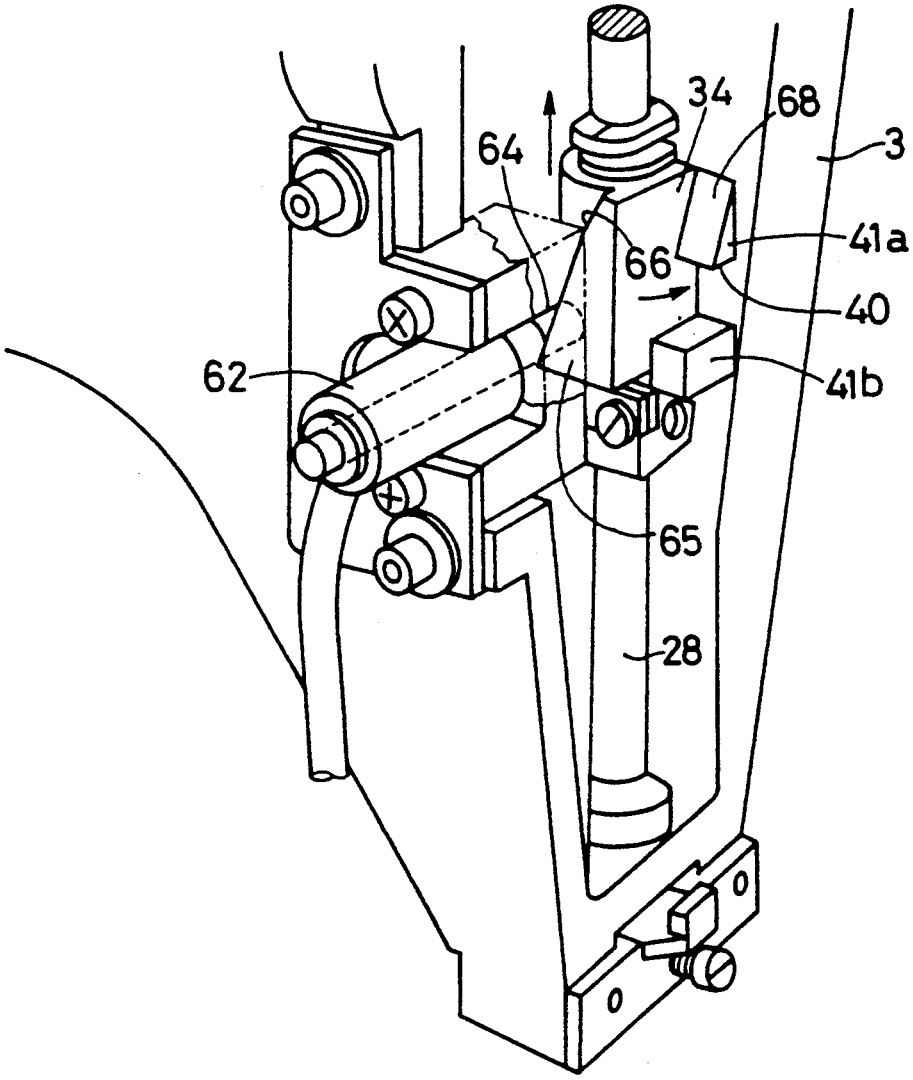
FIG. 3 is a perspective view of the needle-bar jump device also incorporated in the machine.

The present automatic sewing machine is equipped with a needle-bar jump device whose essential portion is shown in the perspective view of FIG. 3. Adjacent to the guide rod 28, there is disposed an actuator in the form of a solenoid 62 having a movable plunger connected to an actuator rod 64. On the other hand, the rotatable member 34 has a cam follower 65 having an inclined surface 66 which is inclined with respect to the longitudinal direction of the guide rod 28, i.e., the direction of reciprocation of the rotatable member 34. The actuator rod 64, which serves as a cam engageable with the inclined surface 66 of the cam follower 65, has an advanced or operated position and a retracted or non-operated position. In the operated position, the rod 64 is engageable with the inclined surface 66, being located in a path of movement of the inclined surface 66 when the rotatable member 34 is reciprocated along the guide rod 28. In the non-operated position, the rod 64 is spaced apart from the above-indicated path of the inclined surface 66, and is not engageable with the surface 66.

When the coil of the solenoid 62 is energized, the actuator rod 64 is advanced to the operated position. If the rotatable member 34 is lifted with the first reciprocating member 30 along the guide rod 28 while the rod 64 is in the operated position, the inclined surface 66 of the cam follower 65 is brought into contact with the actuator rod 64. The inclined surface 66 is formed so that the rotatable member 34 is rotated to the second angular position, in the direction as indicated by arrow in FIG. 3, when the inclined surface 66 contacts the actuator rod 64. As a result, the engaging pin 38 of the second reciprocating member 36 is disengaged from the engaging recess 40 provided on the rotatable member 34, whereby the second reciprocating member 36 is released from the rotatable member 34. Consequently, the needle bar 4 is jumped up, that is, moved to the uppermost position under the biasing action of the compression coil spring 46.

When the coil of the solenoid 62 is de-energized, the actuator rod 64 is retracted to the non-operated position, the rotatable member 34 is rotated to the first angular position under the biasing force of a spring (not shown), whereby the engaging pin 38 is brought into engagement with the engaging recess 40. The rotatable member 34 is held in this first angular position as long as the actuator rod 64 is placed in the non-operated position.

It will be understood that the needle-bar jump device is constituted principally by the coil spring 46, rotatable member 34 with the engaging recess 40, and second reciprocating member 36 with the engaging pin 38.

As also shown in FIG. 3, the upper tab 41*a* of the rotatable member 34 which defines the upper end of the recess 40 has an inclined surface 68 which is inclined with respect to the direction of reciprocating of the rotatable member 34. The inclined surface 68 is formed so as to generally face the end of the engaging pin 38 extending from the second reciprocating member 36. When the rotatable member 34 is moved upward while the engaging pin 36 is disengaged from the engaging recess 40, the inclined surface 68 is brought into engagement with the engaging pin 38, whereby the rotatable member 34 is rotated to the second angular position. When the rotatable member 34 reaches its uppermost position, the inclined surface 68 (upper tab 41*a*) is disengaged from the engaging pin 38, whereby the rotatable member 34 is permitted to be rotated to the first angular position under the biasing force. As a result, the engaging pin 38 is brought into engagement with the engaging recess 40. When the rotatable member 34 is subsequently lowered, the needle bar 4 is lowered with the second reciprocating member 36 and the rotatable member 34, against the biasing force of the compression coil spring 46.

Figure 4:
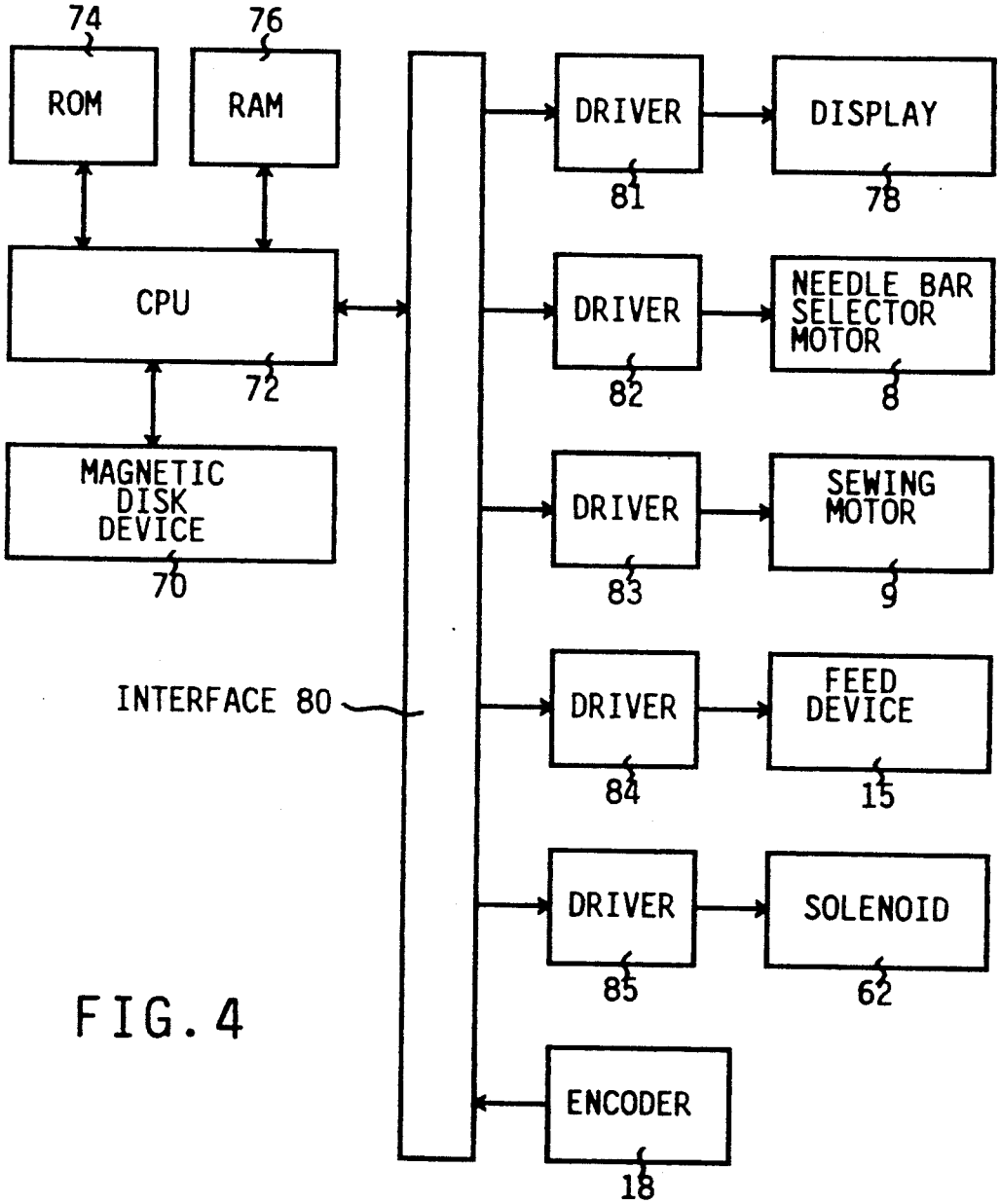
FIG. 4 is a schematic block diagram showing a control system of the machine.

Referring next to the block diagram of FIG. 4, there is shown a control system of the instant automatic sewing machine equipped with the needle-bar jump device. The control system includes a magnetic disk device 70 having a magnetic disk for storing stitch data for performing a desired sewing operation. The stitch data includes data indicative of needle positions at which the needle 5 penetrates the work fabric W for forming stitches.

The control system further includes a central processing unit (CPU) 72, a program memory in the form of a read-only memory (ROM) 74, a working memory in the form of a random-access memory (RAM) 76, and a display in the form of a cathode ray tube 78. The ROM 74 stores various control programs for controlling the motors 8, 9, feed device 15, solenoid 62, and CRT display 78. The RAM 76 is used to temporarily store various sorts of data during arithmetic and logic operations by the CPU, and when the stitch data is prepared and stored in the magnetic disk device 70.

The display 78, selector motor 8, sewing motor 9, drive motors of the feed device 15, and solenoid 62 are connected to an interface 80 through respective driver circuits 81, 82, 83, 84 and 85. The interface 80 is connected to the CPU 72, so that the display 78, motors 8, 9, etc., and solenoid 62 are controlled through the interface 80 and the driver circuits 81–85. As described above, the solenoid 62 which is a part of the needle-bar jump device is provided to jump the needle bar 4 to its uppermost position to hold the needle 5 above the fabric W, by disconnecting the needle bar 4 from the needle-bar reciprocating device which includes the sewing motor 9. The encoder 18 serving as the needle detecting means is also connected to the interface 80, so that the output of the encoder 18 is applied to the CPU 72.

Figure 5:
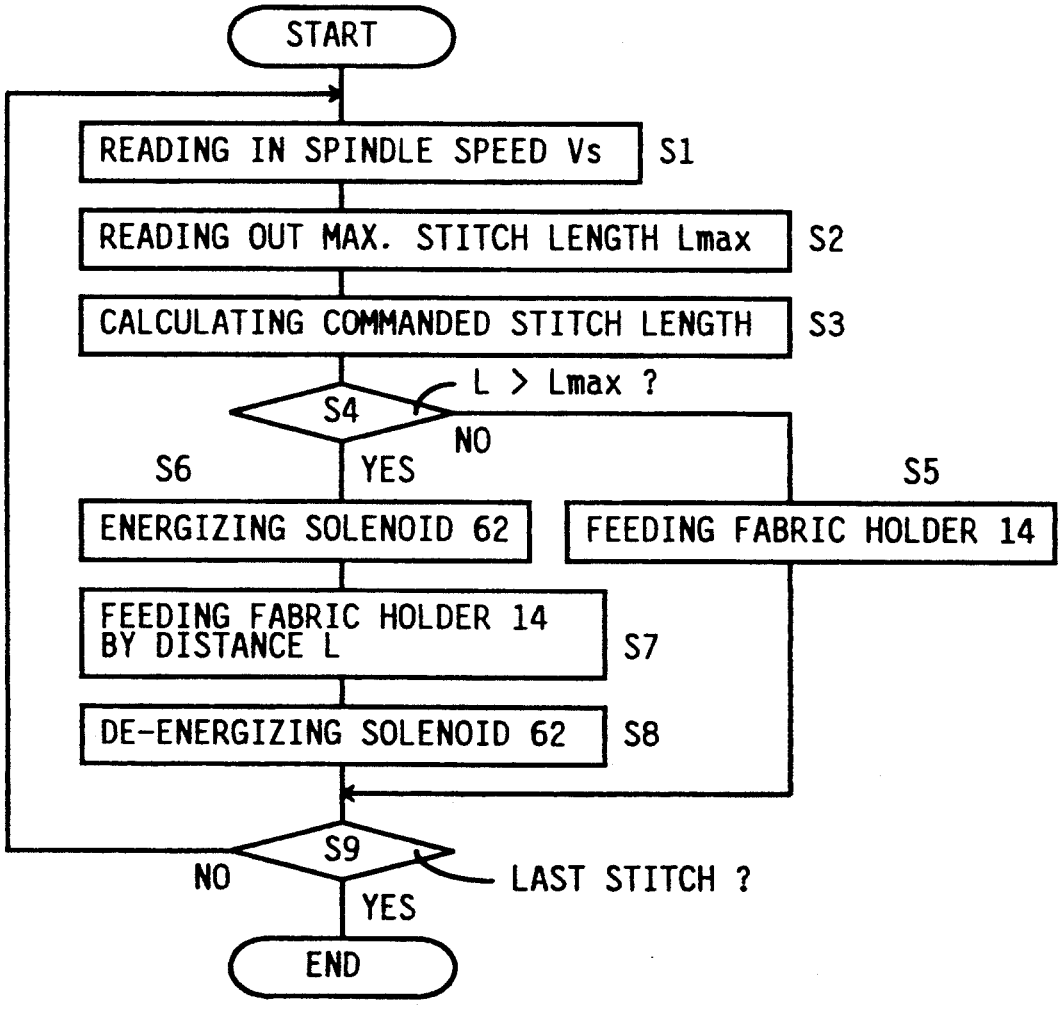
FIG. 5 is a flow chart illustrating a jump stitching operation performed in the embodiment of FIG. 1.

The ROM 72 stores a jump stitching control routine as illustrated in the flow chart of FIG. 5, which is executed by the CPU 72 to perform a jump stitching operation. More specifically, step S1 is initially executed. In this step, a rotating speed Vs of the sewing spindle 20 which was selected by the user of the machine is read in, and the sewing motor 9 is operated to rotate the main spindle 20 at the selected speed. Step S1 is followed by step S2 to read out from the ROM 74 the maximum stitch length Lmax corresponding to the selected spindle speed Vs, by referring to the Lmax-Vs relationship stored in the ROM 74. The control flow then goes to step S3 to read in a first set of stitch data from the magnetic disk device 70, and calculate the length L of the first stitch represented by the stitch data set.

Step S3 is followed by step S4 to determine whether the commanded stitch length L is larger than the maximum stitch length Lmax, or not. Usually, the stitch length L is smaller than the maximum stitch length Lmax, and the control flow goes to step S5 in which the fabric holder 14 is moved by a distance equal to the stitch length L, while the selected needle 5 is above the fabric W during one rotation of the main spindle 20. This movement of the fabric holder 14 to feed the fabric W is started when the needle 5 has just left the fabric W during its upward movement. This position of the needle 5 is represented by the output of the encoder 18. Thus, a stitch having the length L represented by the stitch data is formed on the fabric W.

If the stitch length L is larger than the maximum stitch length Lmax, step S4 is followed by steps S6 and S7. In step S6, the solenoid 62 is energized to rotate the rotatable member 34 to the second angular position, for disengaging the engaging pin 38 of the second reciprocating member 36 from the engaging recess 4 of the rotatable member 34, whereby the needle bar 4 is jumped to its uppermost position under the biasing force of the coil spring 46, so that the needle 5 is positioned above the fabric W. In step S7, the feed device 15 is operated to move the fabric holder 14 for feeding the fabric W by a distance equal to the stitch length L. Since this length L is larger than the maximum stitch length Lmax, the movement of the fabric holder 14 requires two or more rotations of the main spindle 20 (two or more reciprocations of the rotatable member 34), during which the needle 5 is kept above the fabric W. The control flow then goes to step S8 to de-energize the solenoid 62 to permit the rotatable member 34 to return the first angular position for engagement of the engaging pin 38 with the engaging recess 40, when the rotatable member 34 is next lifted. Consequently, the needle bar 4 is lowered from its uppermost position, and the needle 5 penetrates the fabric W. Thus, a "jump stitch" having the relatively large length L is formed on the fabric W.

Step S8 is followed by step S9 to determine whether or not the stitch formed in step S5 or steps S7–S8 is the last stitch to be formed in the relevant sewing cycle according to the stitch data in the magnetic disk device 70. If not, the control flow returns to step S1, to repeat the steps S2–S9, until an affirmative decision (YES) is obtained in step S9.

Figure 6:
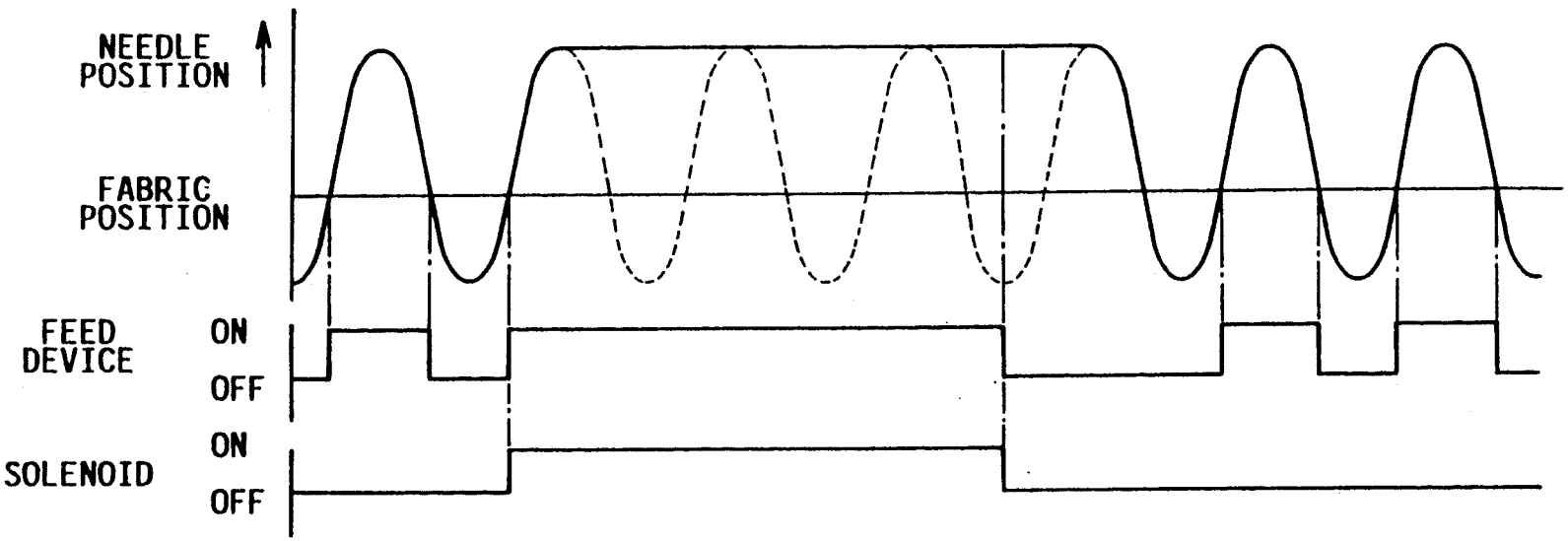
FIG. 6 is a timing chart showing the operations of the feed device and the actuator of the needle-bar jump device in the jump stitch operation of FIG. 5.

There is shown in FIG. 6 a jump stitching operation to form the "jump stitch" formed in steps S7–S8 described above. In this specific example, the solenoid 62 is held energized during a time period corresponding to 2. 75 reciprocations of the needle 5 which would occur if the solenoid 62 of the jump device were not activated. During this time period, the feed device 15 is kept operated to continuously move the fabric holder 14, During this period, no stitch is formed since the needle 5 is held above the fabric W with the needle bar 4 held at the uppermost position due to energization of the solenoid 62.

After the solenoid 62 is de-energized, the needle 5 is lowered to penetrate the fabric W. Thus, there is formed a jump stitch whose length L is larger than the maximum stitch length Lmax and corresponds to 2.75 revolutions of the main spindle 20. Generally, the rotating speed of the main spindle 20 decreases with an increase in the stitch length L. In the present embodiment, however, the speed of the spindle 20 during the jump stitching operation is fixed at the speed corresponding to the maximum stitch length Lmax. Namely, the spindle speed does not decrease with an increase in the stitch length L, if the length L exceeds the maximum stitch length Lmax. This assures a relatively high velocity of movement of the fabric holder 14 for a jump stitch.

It will be understood from the above explanation that during the jump stitching operation, the fabric holder 14 is continuously moved, during the time spans during which the needle 5 is below the fabric W, as well as during the time spans during which the needle 5 is above the fabric W.

Figure 7:
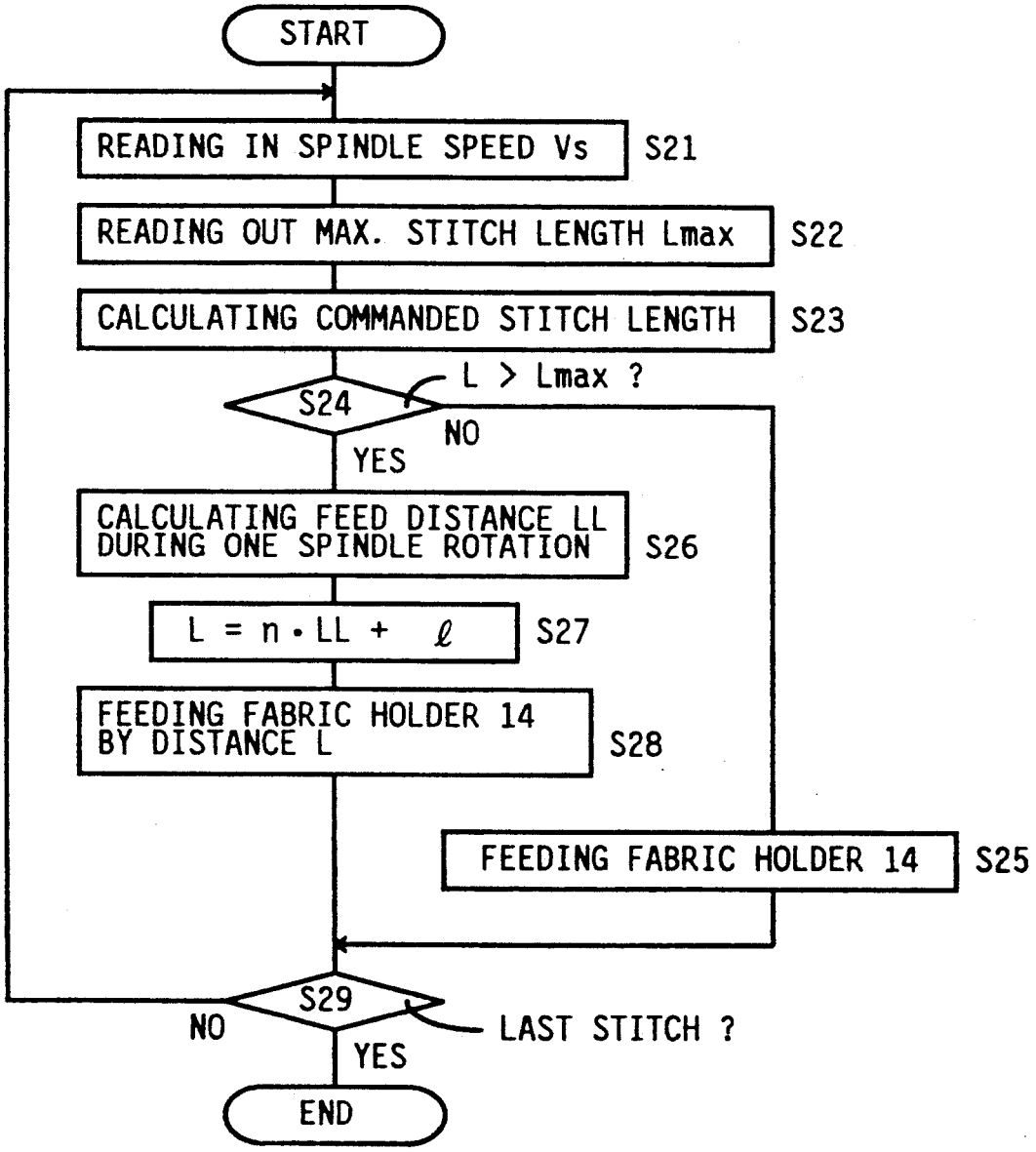
FIG. 7 is a flow chart illustrating a jump stitching operation performed in a modified embodiment of the invention.

Referring next to the flow chart of FIG. 7, there will be described a modified jump stitching control routine alternative to that of FIG. 5. This modified routine is started with step S21, in which the rotating speed Vs of the sewing spindle 20 which was selected by the machine user is read in, and the sewing motor 9 is operated to rotate the main spindle 20 at the selected speed. Step S21 is followed by step S22 to read out from the ROM 74 the maximum stitch length Lmax corresponding to the selected spindle speed Vs. The control flow then goes to step S23 to read in a first set of stitch data from the magnetic disk device 70, and calculate the length L of the first stitch represented by the stitch data set.

Step S23 is followed by step S24 to determine whether the commanded stitch length L is larger than the maximum stitch length Lmax, or not. If the stitch length L is smaller than the maximum stitch length Lmax, the control flow goes to step S25 in which the fabric holder 14 is moved by a distance equal to the stitch length L, while the selected needle 5 is above the fabric W during one revolution of the main spindle 20. This movement of the fabric holder 14 to feed the fabric W is started when the needle 5 has just left the fabric W during its upward movement. This position of the needle 5 is represented by the output of the encoder 18. Thus, a stitch having the length L represented by the stitch data is formed on the fabric W.

It will be understood that steps S21 through S25 are the same as steps S1 through S5 in the embodiment of FIG. 5.

If the stitch length L is larger than the maximum stitch length Lmax, step S26 is implemented to read out from the ROM 74 a feed distance LL of the fabric holder 14, that is obtained during one full rotation of the main spindle 20, by referring to the LL-Vs relationship stored in the ROM 74. That is, the feed distance LL is a distance obtained during one reciprocation of the needle 5, which distance includes a portion obtained while the needle 5 is positioned below the fabric W. It will be understood that the feed distance LL is equal to the maximum stitch length Lmax.

The control flow then goes to step S27 to calculate the number "n" according to the following equation:

$$L = n \cdot LL + l$$

where, P is a fraction of the feed distance LL.

In the next step S28, the feed device 15 is operated to move the fabric holder 15 by a distance equal to the stitch length L. At the same time, the solenoid 62 is energized intermittently, the "n+1" times, so that the needle 5 is held at the uppermost position while the work holder 14 is moved. As a result, a jump stitch is formed on the work fabric W. This jump stitching operation is illustrated in FIG. 8.

Step S28 is followed by step S29 to determine whether or not the stitch formed in step S25 or S28 is the last stitch to be formed in the relevant sewing cycle. Steps S21–S29 are repeated until the last stitch is formed.

Figure 8:
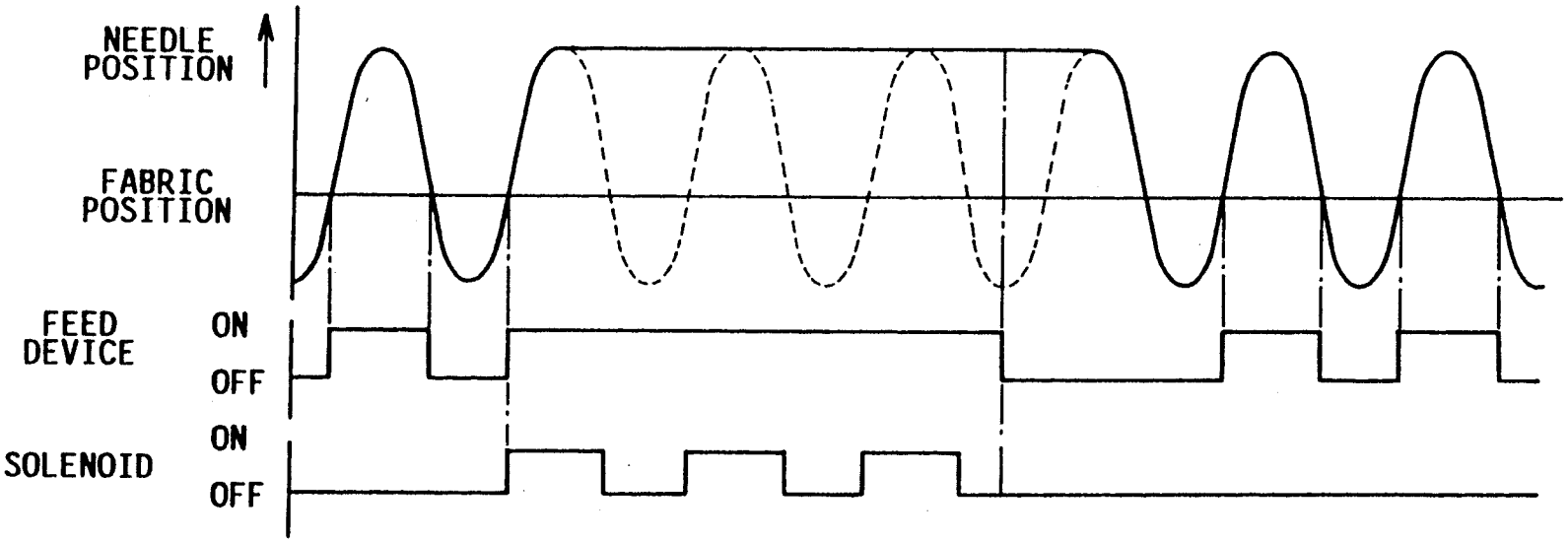
FIG. 8 is a timing chart of the modified embodiment of FIG. 7, which corresponds to that of FIG. 6.
Figure 10:
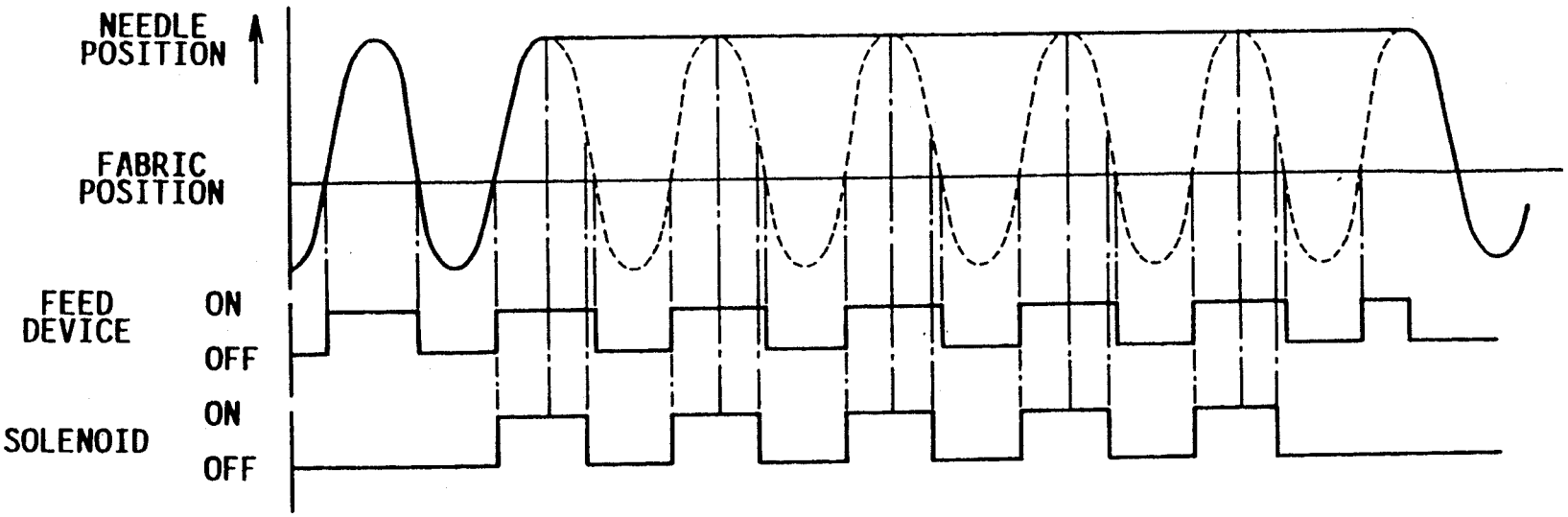
FIG. 10 PRIOR ART
FIG. 10 is a timing chart showing the operations of the feed device and the needle-bar jump device in a known automatic sewing machine.

In the specific example of FIG. 8, the solenoid 62 is energized three times ("n+1" times), since the stitch length L corresponds to 2.75 revolutions of the main spindle 20, that is, the number "n" is equal to "2" while the fraction P is equal to "0.25 LL". After the solenoid 62 is de-energized after the last energization, the needle bar 4 is lowered from the uppermost position, and the needle penetrates the fabric W, to form a jump stitch whose length L is larger than the maximum stitch length Lmax (=feed distance LL per one full rotation of the spindle 20). As in the preceding embodiment, the work holder 14 is not intermittently moved (as in the prior art of FIG. 10), but is continuously moved until the commanded length L (>Lmax) of the jump stitch is obtained.

In the present modified embodiment, the time of continuous energization of the solenoid 62 is reduced, whereby the power consumption by the solenoid 62 is reduced, and the amount of heat generated by the solenoid 62 is accordingly reduced.

Figure 9:
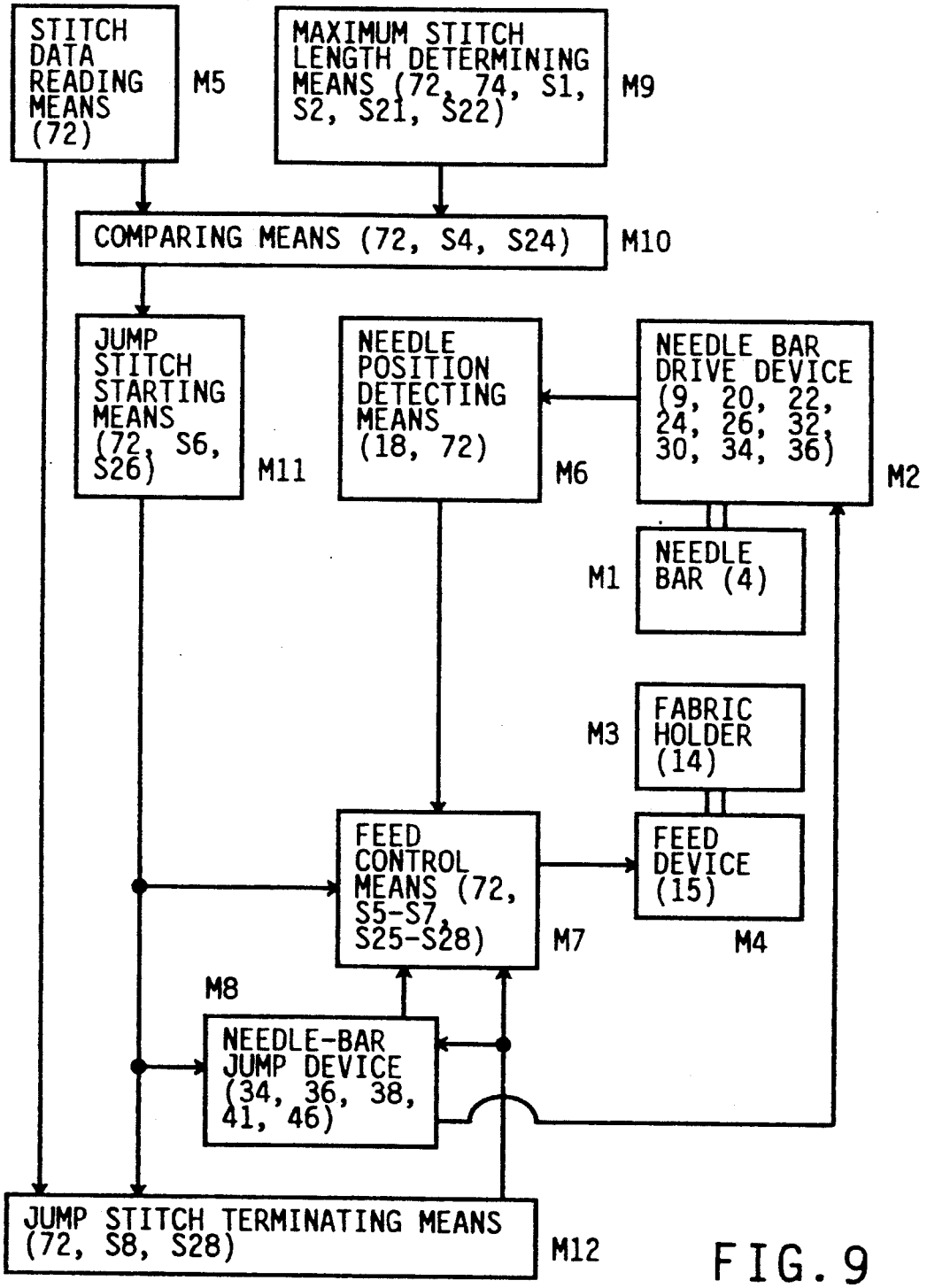
FIG. 9 is a schematic block diagram for clarifying various functional elements of the illustrated embodiments.

For easier understanding of the illustrated embodiments, the functional elements of the sewing machine are illustrated in the schematic block diagram of FIG. 9, in which the needle bar M1 (4) is reciprocated in its longitudinal direction by the needle-bar drive device M2 (9, 20, 22, 24, 26, 30, 32, 34, 36) which includes a needle-bar drive source (9). The fabric holder M3 (14) carrying the work fabric (W) is moved relative to the needle bar, by the feed device M4 (15), in a direction perpendicular to the longitudinal direction of the needle bar. In operation of the sewing machine, the stitch data reading means M5 (72) reads out from the stitch data memory means (76) a batch of stitch data indicative of the needle positions at which the needle (5) penetrates the fabric, and the output of the needle position detecting means M6 (18, 72) is fed to the feed control means M7 (72, S5–S7, S25–S28), which controls the feed device M4 according to the stitch data read by the stitch data reading means M5, when the needle is above the work fabric. The needle-bar jump device M8 (34, 36, 38, 41, 46) is associated with the feed control means M7, for disconnecting the needle bar M1 from the needle-bar drive source (9) of the feed device M4 and holding the needle bar at the uppermost position to maintain the needle above the fabric. The jump stitching means M9–M12 is connected to the feed control means M7, needle-bar-jump device (M8) and stitch data reading means M5. More specifically, the jump stitching means includes the maximum stitch length determining means M9 (72, 74, S1, S2, S21, S22) for determining the maximum stitch length Lmax per one reciprocation of the needle bar, and comparing means M10 (72, S4, S24) for comparing the stitch length (L) represented by the stitch data with the maximum stitch length (Lmax, LL), and thereby determining whether the stitch length (L) is larger than the maximum stitch length (Lmax). The jump stitching means further includes jump stitch starting means M11 (72, S6, S28) for starting a jump stitching operation when the stitch length (L) is larger than the maximum stitch length (Lmax). The jump stitching operation includes placing the feed control means M7 in an inoperative state, and holding the feed device (M4) and the needle-bar-jump device M8 in operated states to produce a continuous relative movement of the needle bar M1 and the fabric. The jump stitching means further includes jump stitch terminating means M12 (72, S8, S28) for restoring the feed control means M7 to an operative state and restoring the needle-bar jump device M8 to a non-operated state, when a needle position represented by the stitch data is reached by the continuous movement of the needle bar and the fabric.

While the present invention has been described above in its presently preferred embodiments with a certain degree of particularity, it is to be understood that the invention is not limited to the details of the illustrated embodiments, but may be embodied with various changes, modifications and improvements, which may occur to those skilled in the art, without departing from the spirit and scope of the invention defined in the following claims.

What is claimed is:

1. An automatic sewing machine comprising:

a needle bar carrying a needle;

a needle-bar drive device having a needle-bar drive source, for reciprocating the needle bar in a longitudinal direction thereof;

a feed device for producing a relative movement between the needle bar and a work fabric, in a direction substantially perpendicular to said longitudinal direction;

stitch data reading means for reading stitch data indicative of needle positions at which the needle penetrates a work fabric;

feed control means for controlling the feed device according to said stitch data read by said stitch data reading means, when the needle is above the work fabric;

a needle-bar jump device for disconnecting said needle bar from said needle-bar drive source, and holding said needle bar at a predetermined position to maintain the needle above said work fabric; and jump stitching means operable, when a stitch length represented by a particular set of said stitch data read by said stitch data reading means exceeds a maximum stitch length, for executing a jump stitching operation which includes placing said feed control means in an inoperative state, placing said needle-bar jump device and said feed device in operated states to produce a continuous relative movement between said needle bar and said work fabric, and restoring said feed control means and said needle-bar jump device to an operative state and a non-operated state, respectively, when a needle position represented by said particular set of stitch data is reached by said continuous relative movement.

2. An automatic sewing machine according to claim 1, further comprising a work holder for holding said work fabric, and wherein said feed device moves said work holder to produce said relative movement between said needle bar and said work fabric.

3. An automatic sewing machine according to claim 1, further comprising position detecting means for detecting a position of said needle bar in said longitudinal direction, and wherein said feed control means (M7) operates said feed device (M4) in response to an output of said position detecting means.

4. An automatic sewing machine according to claim 1, wherein said jump stitching means includes memory means for storing maximum stitch length data representative, of said maximum stitch length, and said jump stitching means reads out from said memory means said maximum stitch length data, and starts said jump stitching operation when said stitch length represented by said stitch data read by said stitch data reading means exceeds said maximum stitch length represented by said maximum stitch length data.

5. An automatic sewing machine according to claim 1, wherein said jump stitching means includes jump stitch starting means for starting said jump stitching operation when said stitch length represented by said stitch data read by said stitch data reading means exceeds said maximum stitch length, and jump stitch terminating means (M12) for terminating said jump stitching operation when said needle position represented by said particular set of stitch data is reached by said continuous relative movement of said needle bar and said work fabric.

6. An automatic sewing machine according to claim 1, further comprising a link mechanism having a first position for connecting said needle bar and said needle-bar drive device, and a second position for disconnecting said needle bar from said needle-bar drive device, and wherein said needle-bar jump device operates to place said link mechanism in said second position.

7. An automatic sewing machine according to claim 6, wherein said needle-bar drive device includes a first reciprocating member which is reciprocable in a direction parallel to said longitudinal direction of said needle bar, and a second reciprocating member which is reciprocable with said needle bar in said longitudinal direction, said link mechanism is provided between said first and second reciprocating members.

8. An automatic sewing machine according to claim 7, wherein said link mechanism comprises: a second engaging portion reciprocable with said second reciprocating member; a rotatable member having a first engaging portion engageable with said second engaging portion, said rotatable member being reciprocable with said first reciprocating member, and rotatable between a first angular position for engagement of said first engaging portion with said second engaging portion, and a second angular position for disengagement of said first engaging portion from said second engaging portion; and biasing means for biasing said rotatable member toward said first angular position, and in that said needle-bar jump device comprises an actuator for rotating said rotatable member to said second angular position against a biasing action of said biasing means.

9. An automatic sewing machine according to claim 8, wherein said actuator comprises:

a cam follower reciprocable with said rotatable member and having an inclined surface inclined with respect to the direction of reciprocation of said rotatable member;

a cam movable between an operated position for engagement with said inclined surface of said cam follower to rotate said rotatable member to said second angular position when said rotatable member is lifted, and a non-operated position spaced apart from a path of said inclined surface taken when said rotatable member is reciprocated; and a cam operating device for moving said cam between said operated and non-operated position.

10. An automatic sewing machine according to claim 9, wherein said cam operating device includes a solenoid having a movable plunger connected to said cam, and a coil which is energized and de-energized to move said movable plunger to move said cam to one and the other of said operated and non-operated positions.

11. An automatic sewing machine according to claim 10, wherein said movable plunger is moved to move said cam to said operated position when said coil is energized, and that said coil is intermittently energized in synchronization with a lifting movement of said rotatable member during said jump stitching operation.

12. An automatic sewing machine according to claim 10, wherein said movable plunger is moved to move said cam to said operated position when said coil is energized, and that said coil is held energized while said jump stitching operation is performed.

13. An automatic sewing machine according to claim 1, wherein said needle-bar drive device includes a main spindle, and said jump stitching means includes determining means for determining said maximum stitch length depending upon a rotating speed of said main spindle.

14. An automatic sewing machine according to claim 13, wherein said determining means includes:

memory means for storing a relationship between said maximum stitch length and said rotating speed of said main spindle; and reading means for reading out from said memory means said maximum stitch length which corresponds to a current value of said rotating speed.

* * * * *